US005486334A

United States Patent [19]

Hollander

[11] Patent Number: 5,486,334

[45] **Date of Patent: * Jan. 23, 1996**

[54] METHODS FOR INHIBITING METAL CORROSION IN AQUEOUS MEDIUMS

[75] Inventor: Orin Hollander, Warwick, Pa.

[73] Assignee: Betz Laboratories, Inc., Trevose, Pa.

[ * ] Notice: The portion of the term of this patent subsequent to Jan. 3, 2012, has been disclaimed.

[21] Appl. No.: 198,174

[22] Filed: Feb. 17, 1994

[51] Int. Cl.[6] ..... C23F 11/14; C23F 11/16

[52] U.S. Cl. ..... 422/16; 252/391; 252/394

[58] Field of Search ..... 422/7, 12, 13, 422/14, 16; 106/14.16, 14.29; 252/391, 394

[56] References Cited

U.S. PATENT DOCUMENTS

| | | | |
|---|---|---|---|
| 3,413,227 | 11/1968 | Howard et al. | 106/14.16 X |
| 3,803,049 | 4/1974 | Korpics | 252/394 X |
| 3,895,170 | 7/1975 | Tanaka et al. | 428/457 |
| 3,985,503 | 10/1976 | O'Neal, Jr. | 422/7 |
| 4,184,991 | 1/1980 | Scheurman, III | 252/394 X |
| 4,343,660 | 8/1982 | Martin | 106/14.29 X |
| 4,698,162 | 10/1987 | Guilbault et al. | 210/710 |
| 4,744,950 | 5/1988 | Hollander | 422/16 |
| 5,217,686 | 6/1993 | Vanderpool et al. | 252/394 X |
| 5,378,373 | 1/1995 | Hollander | 210/698 |

FOREIGN PATENT DOCUMENTS 1065995 12/1964 United Kingdom .

*Primary Examiner*—Timothy M. McMahon
*Assistant Examiner*—Robert Carpenter
*Attorney, Agent, or Firm*—Alexander D. Ricci; Philip H. Von Neida

[57] ABSTRACT

Methods are provided for inhibiting the corrosion of metals in contact with aqueous systems. Sulfono benzotriazole compounds or their salts are added to these aqueous systems to inhibit the corrosion of metal, such as iron surfaces present in cooling water systems.

11 Claims, No Drawings

METHODS FOR INHIBITING METAL CORROSION IN AQUEOUS MEDIUMS

FIELD OF THE INVENTION

The present invention relates to methods for inhibiting the corrosion of metals in aqueous systems. These methods are particularly effective in cooling water systems experiencing corrosion due to the presence of copper ions.

BACKGROUND OF THE INVENTION

In many industrial processes, undesirable excess heat is removed by the use of heat exchangers in which water is used as the heat exchange medium. Copper and copper-bearing alloys are often used in the fabrication of such heat exchangers, as well as in other parts in contact with the cooling water, such as pump impellers, stators and valve parts.

The cooling water systems most often used are of the recirculating type where the water is used repetitively and, as a result, remains in extended contact with the metals of the cooling water system. The cooling water is often corrosive towards these metals given the ions present and the intentional introduction of oxidizing substances for biological growth control. In refinery operations, these cooling waters are often contaminated by "sour" leaks which result in hydrocarbons, sulfides, polysulfides, and hydrogen sulfide being present in the cooling water.

These contaminants can become problematic if they are left untreated and can quickly overwhelm any standard operating treatment. The hydrocarbons can coat the metal surfaces of the cooling system and prevent corrosion inhibitors from working correctly. Sulfide ions can cause severe corrosion of metals and are particularly corrosive of copper and its alloys, such as brass and admiralty metal.

Hydrogen sulfide will penetrate copper metallurgy and will form cupric sulfide. The consequences of such corrosion are the loss of metal from the equipment, leading to failure or requiring expensive maintenance, creation of insoluble corrosion product films on the heat exchange surfaces leading to decreased heat transfer and subsequent loss of productivity. Discharge of copper ions can result in them "plating out" on less noble metal surfaces, such as iron, and cause severe galvanic corrosion. Copper discharge is also a health and environmental concern due to its toxicity.

Steel corrosion is a degradative electrochemical reaction of the metal with its environment. Simply stated, it is the reversion of refined metals to their natural state. For instance, iron ore is iron oxide which is refined into steel. Corrosion of the steel results in the formation of iron oxide which, if left unattended, may result in failure or even destruction of the metal.

SUMMARY OF THE INVENTION

This invention relates to methods for inhibiting the corrosion of metals in aqueous system utilizing a sulfono benzotriazole compound.

It has been discovered that the use of sulfono benzotriazole compounds is effective at inhibiting the corrosion of iron, copper and their alloys when there is an excess of free copper ions in cooling water systems.

DESCRIPTION OF THE RELATED ART

Substituted benzotriazole compounds have shown effectiveness as metal corrosion inhibitors. British Patent No. 1,065,995 teaches that 5-alkyl substituted benzotriazoles are effective at reducing corrosion or tarnish of copper items in the presence of atmospheric sulfides. U.S. Pat. No. 3,985,503 teaches the use of carboxylated benzotriazoles to inhibit corrosion of metals in contact with corrosive organic liquids and aqueous systems.

U.S. Pat. No. 4,744,950 discusses the use of $C_3$ to $C_6$ substituted alkyl benzotriazoles to provide a corrosion inhibiting film on copper-containing metals in open cooling water systems. These cited examples provide corrosion inhibition by forming a thin film on the copper surface in contact with the aqueous system. However, corrosion does not end as copper ions still plate out on iron and steel surfaces and lead to galvanic corrosion of the iron and steel metals.

DETAILED DESCRIPTION OF THE INVENTION

The present invention provides for methods for inhibiting the corrosion of metal surfaces in contact with an aqueous system containing aggressive ions comprising adding to said aqueous system an effective corrosion inhibiting amount of a sulfono benzotriazole compound or salt thereof.

The methods of the present invention prove effective at inhibiting the corrosion of ferrous metal surfaces in cooling water systems. Unlike the other substituted benzotriazole compounds, the sulfono benzotriazole compounds form soluble complexes with copper (I) and copper (II) ions that are present in the cooling water. These ions are present, to some extent, in the makeup water, but they are prevalent when sulfur containing contaminants are present in the cooling water. These copper ions galvanically deposit on less noble ferrous metal surfaces and initiate a galvanic corrosion cell, leading to ferrous metal corrosion. Further, the copper ions can also impinge on other metal surfaces and cause corrosion by erosion of the surfaces. The water soluble complex formed by the sulfono benzotriazole compounds and the copper ions keeps the ions out of free solution and can be removed from the cooling water system by blowdown.

The sulfono benzotriazole compounds have the formula:

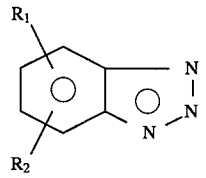

wherein $R_1$ and $R_2$ are each independently H, $C_1$ to $C_6$ alkyl, alkoxy, or halide, with the proviso that at least one of $R_1$ or $R_2$ be $SO_3H$, $SO_3M$, $R_3SO_3H$ or $R_3SO_3M$, wherein $R_3$ is a $C_1$ to $C_6$ alkyl group and M is an alkali metal or alkaline earth metal.

The preferred sulfono benzotriazole compounds are those where $R_1$ is $SO_3M$ and $R_2$ is a $C_1$ to $C_6$ alkyl group. Preferred among these are when $R_1$ is $SO_3Na$ and $R_2$ is methyl, designated the sodium salt of 5-sulfono tolyltriazole.

The total amount of sulfono benzotriazole compound used in the methods of the present invention is that amount which is sufficient to inhibit corrosion in the cooling water system and will vary according to the conditions in the cooling water system. Higher sulfide concentrations and the presence of other corrosive agents, such as biocides, will increase the copper ion concentration. As such, larger amounts of sulfono benzotriazole compounds need be added to the cooling water system.

Generally, the sulfono benzotriazole compound is added to the cooling water in a range from 0.1 parts to 100 parts per million parts cooling water. The sulfono benzotriazole is added in excess of 3.7 parts per million for every part per million of copper ion present. Combinations of 2 or more sulfono benzotriazole compounds may be added to the cooling water in conjunction with each other.

The sulfono benzotriazole can be applied to the aqueous system in any conventional manner and can be fed to the aqueous system neat or in any suitable solvent means. Water, glycol and polyglycols can be used as the solvent. The sulfono benzotriazole is preferably added as an aqueous solution in either a continuous or intermittent fashion.

Other corrosion inhibitors or dispersants may be used in combination with the sulfono benzotriazole compounds. These treatments may also be applied with other water treatment agents such as microbiological control species oxidizing and nonoxidizing biocides.

The data set forth below illustrate this invention. These examples are only illustrations and should not be construed as limiting the scope of the present invention.

EXAMPLES

The sodium salt of 5-sulfono tolyltriazole has been shown to react with both copper (I) and copper (II) ions to form a 1:1 complex which is water soluble.

10 ppm of copper (II), derived from $CuSO_4$ plated a low carbon steel test coupon within a few hours, resulting in severe corrosion. Under the same conditions, with a slight excess of the sodium salt of 5-sulfono tolyltriazole (about 40 ppm) present, the solution became a pale green as a result of the reaction of copper (II) with the salt. The carbon steel test coupon remained free of deposited copper for the test duration of one week. Corrosion of the coupon was slight.

While this invention has been described with respect to particular embodiments thereof, it is apparent that numerous other forms and modifications of this invention will be obvious to those skilled in the art. The appended claims and this invention generally should be construed to cover all such obvious forms and modifications which are within the true spirit and scope of the present invention.

Having thus described the invention, what I claim is:

1. A method for inhibiting the corrosion of ferrous metal surfaces in an aqueous system containing aggressive ions selected from the group consisting of cooper (I) and cooper (II) ions comprising adding to an aqueous system an effective corrosion inhibiting amount of a sulfono benzotriazole compound or salt thereof.

2. The method as claimed in claim 1 wherein said sulfono benzotriazole has the formula:

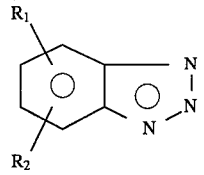

wherein $R_1$ or $R_2$ are each independently H, $C_1$ to $C_6$ alkyl, alkoxy, or a halide, with the proviso that at least one of $R_1$ or $R_2$ be $SO_3H$, $SO_3M$, $R_3SO_3H$ or $R_3SO_3M$, wherein $R_3$ is a $C_1$ to $C_6$ alkyl group and M is an alkali metal or alkaline earth metal.

3. The method as claimed in claim 1 wherein said $R_1$ is $SO_3M$ and said $R_2$ is a $C_1$ to $C_6$ alkyl group.

4. The method as claimed in claim 3 wherein said sulfono benzotriazole is the sodium salt of 5-sulfono tolyltriazole.

5. The method as claimed in claim 1 wherein sulfide ions and oxidizing and non-oxidizing biocides are present in said aqueous system.

6. The method as claimed in claim 1 wherein said sulfono benzotriazole compound is added to said aqueous system in an amount from 0.1 part to about 100 parts per million parts of said copper.

7. The method as claimed in claim 6 wherein said sulfono benzotriazole compound is added to said aqueous system in an amount of about 3.7 parts per million per every part per million of said copper.

8. The method as claimed in claim 1 wherein 2 or more sulfono benzotriazole compounds are added to said aqueous system in conjunction.

9. The method as claimed in claim 1 wherein said sulfono benzotriazole compound is added to said aqueous system in a solvent.

10. The method as claimed in claim 9 wherein said solvent is water.

11. The method as claimed in claim 1 wherein said aqueous system is a cooling water system.

* * * * *